US006564928B1

(12) United States Patent
Darrou et al.

(10) Patent No.: US 6,564,928 B1
(45) Date of Patent: May 20, 2003

(54) DEVICE FOR CONVEYING FLAT OBJECTS WITH A ROUTING SYSTEM

(75) Inventors: Fabrice Darrou, Chabeuil (FR); Vincent Grasswill, Montelier (FR); Alain Danjaume, Besayes (FR)

(73) Assignee: Solystic, Gentilly Cedex (FR)

( * ) Notice: Subject to any disclaimer, the term of this patent is extended or adjusted under 35 U.S.C. 154(b) by 0 days.

(21) Appl. No.: 10/018,040

(22) PCT Filed: Jul. 5, 2000

(86) PCT No.: PCT/EP00/06378

§ 371 (c)(1),
(2), (4) Date: Apr. 29, 2002

(87) PCT Pub. No.: WO01/02278

PCT Pub. Date: Jan. 11, 2001

(30) Foreign Application Priority Data

Jul. 5, 1999 (FR) ..... 99 08610

(51) Int. Cl.[7] ..... B65G 15/14

(52) U.S. Cl. ..... 198/626.1; 271/302; 271/303; 198/369.5; 198/608

(58) Field of Search ..... 198/369.5, 606, 198/608, 626.1; 271/302, 303

(56) References Cited

U.S. PATENT DOCUMENTS 2,810,469 A * 10/1957 Sindzinski ..... 198/369.5
4,416,450 A * 11/1983 van Wijngaarden ..... 271/303
5,150,894 A * 9/1992 Ricciardi ..... 271/302
5,207,858 A * 5/1993 DeBarber et al. ..... 271/302 X
5,386,913 A * 2/1995 Taylor ..... 271/303 X

FOREIGN PATENT DOCUMENTS

DE 1124747 * 3/1962
DE 4317042 * 8/1994
FR 2720535 * 12/1995

* cited by examiner

*Primary Examiner*—James R. Bidwell
(74) *Attorney, Agent, or Firm*—Pitney, Hardin, Kipp & SzuchLLP

(57) ABSTRACT

The deice for conveying flat objects edge-on in series at high speed between an entry (A) and an exit (B) of a conveying path comprises a routing system for diverting some of these flat objects towards another exit (B') between the entry and the exit of the conveying path. This system comprises two mobile flaps (3, 4) kept mutually parallel and arranged between the entry and the exit of the conveying path, and two motorized endless belts (1, 2) moving between these two flaps and between which the flat objects conveyed are gripped, these two flaps being mounted so that they can pivot so as to route the flat objects either towards the exit (B) of the conveying path or towards the other exit (B'). A stationary post (6) is located at the point where the flat objects are routed downstream of the mobile flaps between the entry and the exit of the conveying path. The exit (B) of the conveying path is distant from the stationary post (6), and one (1) of the motorized endless belts extends beyond the stationary post as far as the exit of the conveying path, and this makes it possible to ensure the continuity of the conveying of the envelopes exiting the routing system.

3 Claims, 2 Drawing Sheets

DEVICE FOR CONVEYING FLAT OBJECTS WITH A ROUTING SYSTEM

BACKGROUND OF THE INVENTION

The invention relates to a device conveying flat objects edge-on in series at high speed between an entry and an exit of a conveying path with a routing system for diverting some of these flat objects towards another exit between the entry and the exit of the conveying path, this system comprising two mobile flaps kept mutually parallel and arranged between the entry and the exit of the conveying path, and two motorized endless belts moving between these two flaps and between which the flat objects conveyed are gripped, these two flaps being mounted so that they can pivot so as to route the flat objects either towards the exit of the conveying path or towards the other exit.

A device of this kind is more particularly intended for a machine for automatically processing mail in which it is necessary to extract from the main stream of envelopes conveyed between the destacking unit and the sorting unit of the machine, certain envelopes which are to be rejected before they arrive at the sorting unit, without disrupting the main stream. Machines for processing mail have to be designed to be able to take a broad range of postal items. More specifically, they have to be designed to be able to take flat rectangular envelopes, the thickness of which varies between 0.15 and 32 millimeters while the length and width of these envelopes can vary respectively between 14 and 40 centimeters and between 9 and 30 centimeters.

It is customary for the envelopes for rejection to be diverted using a system comprising two mobile parallel flaps around which the two drive belts are looped. In consequence, in this arrangement, the two belts do not accompany the envelopes all the way to the exit of the conveying device which exit is distant from the two flaps. This break in the conveying device leads to variations in the spacing between consecutive envelopes along the conveying path because of the fact that the two belts let go of the envelopes and these variations in spacing complicate the processing operations performed at the exit of the conveying device.

It is also customary for the envelopes for rejection to be diverted, not using a two-flap system, but using a mobile post. This system is not, however, suited to a broad range of postal envelopes with highly varying thicknesses as mentioned hereinabove.

SUMMARY OF THE INVENTION

The object of the invention is to provide a device for conveying flat objects of varying thickness edge-on and in series at high speed using a two-flap system, allowing some of these objects to be diverted from their conveying path without disrupting the main stream of flat objects.

To this end, the subject of the invention is a conveying device as defined hereinabove, wherein: a stationary post is located at the point where the flat objects are routed downstream of the mobile flaps between the entry and the exit of the conveying path; the exit of the conveying path is distant from the stationary post; and one of the motorized endless belts extends beyond the stationary post as far as the exit of the conveying path. Using this arrangement, it will be understood that just one of the two motorized endless belts is looped around a flap to allow the flat objects to be routed on both sides of the post. Because the other motorized endless belt extends beyond the post as far as the exit of the conveying path, the continuity of the conveying of the flat objects is maintained beyond the routing point, and this plays a part in maintaining the spacing between consecutive flat objects. When the flaps are oriented to divert a flat object towards the other exit, this belt is deformed by one of the flaps against the stationary post and this means that the diverted flat object is still gripped between the two belts as far as the routing point.

According to one particular embodiment of the device according to the invention, the two motorized endless belts are gripped together by a pair of elastically deformable elastomer wheels with stationary rotation spindles arranged on each side of the two mobile flaps. This arrangement is far simpler than an arrangement with pulleys mounted on pivoting arms returned by springs which press the two belts together between the two flaps. In addition, such wheels are better able to absorb the variations in thickness of the flat objects and are better able to accompany the diversion of the flat objects.

According to another particular feature of the device according to the invention, the elastically deformable elastomer wheels each comprise a hub mounted to rotate on a stationary spindle and an annular tread strip in contact with one belt, the hub and the annular tread strip of each wheel being connected by elastically deformable circular-arc-shaped fins, the two ends of each fin, which are for connection to the hub and to the annular tread strip of the wheel, lying on a radius of the wheel. With an arrangement such as this, each wheel can absorb great variations in thickness of the flat objects without fatigue, returning to its normal position very quickly.

BRIEF DESCRIPTION OF THE DRAWINGS

The device according to the invention is described in greater detail hereinbelow and is illustrated in the figures.

DETAILED DESCRIPTION OF THE PREFERRED EMBODIMENTS

Figure 1:
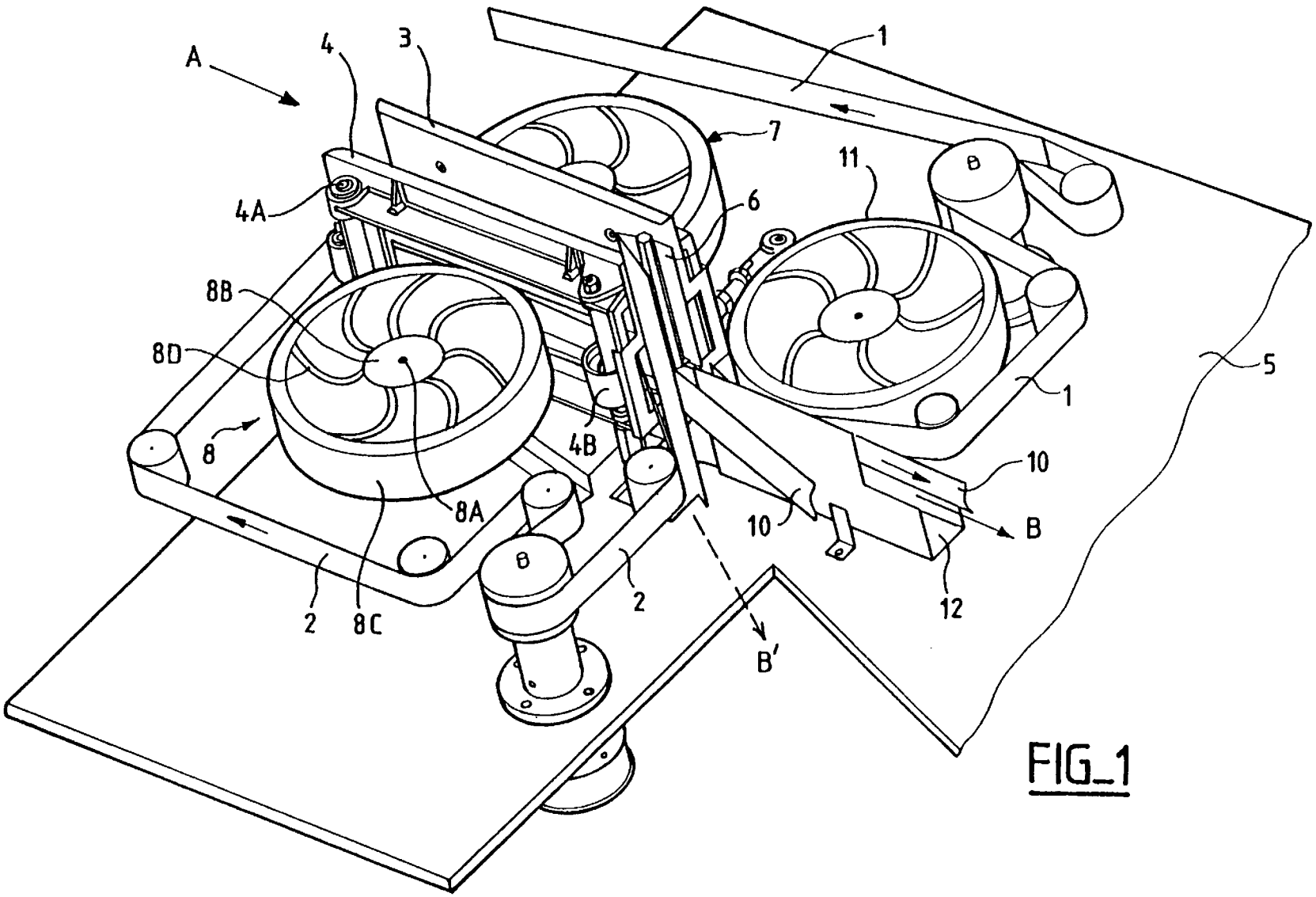
FIG. 1 very diagrammatically shows the device according to the invention, in perspective.
Figure 2:
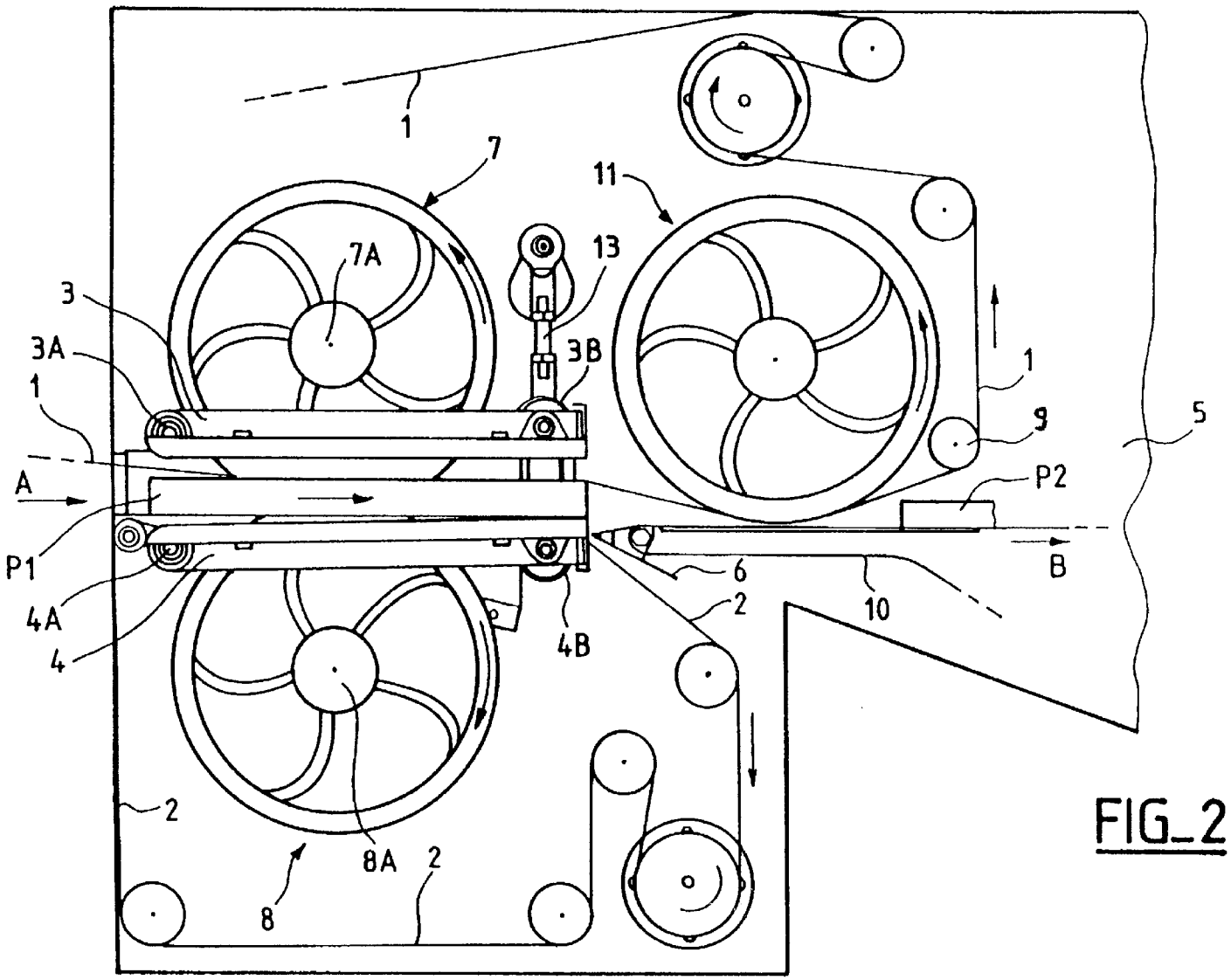
FIG. 2 is a very diagrammatic view from above of the device according to the invention shown in FIG. 1.

The device illustrated in FIGS. 1 and 2 is used for conveying postal envelopes of varying thickness edge-on and in series at high speed between an entry A of a main conveying path and an exit B of this conveying path.

This system can be inserted between an upstream destacking unit and a downstream sorting unit of a machine for processing mail.

The envelopes are gripped between two motorized endless belts 1 and 2 which pass between two mobile flaps 3 and 4 kept mutually parallel and arranged between the entry A and the exit B of the conveying path. The two flaps 3 and 4 are used to divert some of the envelopes introduced into the entry A towards another exit B'.

These two flaps are mounted to pivot at their fixed end closest to the entry A, on a spindle 3A, 4A fixed respectively to the support sole plate 5. The other end of the two flaps closest to the exit B moves angularly at right angles to the conveying path past a routing point at which a stationary post 6 is arranged.

The stationary post 6 arranged downstream of the two mobile flaps 3 and 4 along the conveying path is also used to route the envelopes towards the exit B or the exit B' according to the orientation of the flaps.

As visible in the figures, each flap 3 or 4 has the shape of a rectangular plate arranged vertically on edge along its longest edge which is appreciably longer than the longest length of the envelopes being conveyed. The two flaps are separated from one another in a direction perpendicular to the conveying path by a distance which is slightly greater than the greatest thickness of the envelopes being conveyed. The mobile end of each flap carries a pulley 3B, 4B in contact with a respective endless belt 1 and 2 and the two mobile ends of the flaps are secured by a link rod 13 which is moved at right angles to the conveying path to cause the flaps to pivot jointly, so as to route the envelopes towards the exit B or the exit B'.

Two elastically deformable elastomer wheels 7 and 8 are arranged facing each other on each side of the two flaps 3 and 4. As can be seen in the figures, each flap 3 or 4 has a longitudinal slot through which a respective wheel 7 or 8 penetrates (as visible in FIG. 2) so that the two wheels 7 and 8 press the two belts 1 and 2 together between the two flaps.

The exit B of the conveying path is designed to be distant from the stationary post 6 and it can be seen from the figures that the belt 1 engaged over the wheel 7 and the pulley 3B extends beyond the stationary and this ensures that the envelope is conveyed correctly as far as the exit B'. Thus, the flat objects are routed towards one of the exits B or B' by a deformation of the belts between which the flat objects are gripped under the action of the pulleys 3B, 4B mounted at the mobile end of the flaps 3 and 4.

Furthermore, a fixed endless motorized backing belt 10 is moved between the stationary post 6 and the exit B of the conveying path facing the belt 1. This fixed backing belt may, for example, press against a baseplate 12 in the form of a channel section which is mounted downstream of the routing system. When the flaps 3 and 4 are aligned with the main conveying path, the envelopes leaving the flaps 3 and 4 are gripped between the belt 1 and the belt 10, the belt 1 still ensuring continuity of the conveying of the envelope as far as the exit B without releasing it. Downstream of the exit B from the conveying path, it is the belt 10 which can still ensure the continuity of the conveying of the envelope. The belt 1 is pressed against the fixed backing belt 10 by another elastically deformable elastomer wheel 11 with a stationary spindle. The wheels 7, 8 and 11 here are identical in their structure but the wheels 7 and 8 may have a different hardness to the wheel 11 in terms of deformation.

Each elastically deformable elastomer wheel, for example the wheel 8, has a hub made of elastomer such as 8B mounted to rotate freely on the spindle of the wheel, in this instance the spindle 8A, and an annular tread strip made of elastomer such as 8C in contact with a belt, in this instance the belt 2. The hub 8B and the annular tread strip 8C of the wheel 8 are connected by elastically deformable circular-arc-shaped elastomer fins 8D. The ends of each fin, which ends are for connection to the hub and to the annular tread strip of the wheel, lie on a radius of the wheel, and this allows the wheel to be compressed radially over the entire length of the fins. In the conveying device illustrated in the figures, the wheels 7, 8 and 11 may have a diameter of about 25 centimeters and a thickness of the order of 5 centimeters.

FIG. 2 shows that the two wheels 7 and 8 are compressed radially one against the other to grip a thick envelope P1, while the undeformed wheel 11 presses the belt 1 against the belt 10 between two consecutive envelopes P1 and P2. The ease with which the wheels 7 and 8 can be compressed elastically against each other increases the area of contact of the belts 1 and 2 with the envelope P1 passing between the flaps 3 and 4 and this plays a part in improving the conveying of the envelope in this transit region and in keeping the spacing between consecutive envelopes constant.

We claim:

1. A device for conveying flat objects edge-on in series at high speed between an entry (A) and an exit (B) of a conveying path with a routing system for diverting some of these flat objects towards another exit (B') between the entry and the exit of the conveying path, this system comprising two mobile flaps (3, 4) kept mutually parallel and arranged between the entry and the exit of the conveying path, and two motorized endless belts (1, 2) moving between these two flaps and between which the flat objects conveyed are gripped, these two flaps being mounted so that they can pivot so as to route the flat objects either towards the exit (B) of the conveying path or towards the other exit (B'), wherein: a stationary post (6) is located at the point where the flat objects are routed downstream of the mobile flaps between the entry and the exit of the conveying path; the exit (B) of the conveying path is distant from the stationary post (6); and one (1) of the motorized endless belts extends beyond the stationary post as far as the exit of the conveying path.

2. The device as claimed in claim 1, in which the two motorized endless belts are pressed together by a pair of elastically deformable elastomer wheels (7, 8) with stationary rotation spindles arranged on each side of the two mobile flaps.

3. The device as claimed in claim 2, in which the elastically deformable elastomer wheels each comprise a hub (8B) mounted to rotate on a stationary spindle (8A) and an annular tread strip (8C) in contact with one belt, the hub and the annular tread strip of each wheel being connected by elastically deformable circular-arc-shaped fins (8C), the two ends of each fin, which are for connection to the hub and to the annular tread strip of the wheel, lying on a radius of the wheel.

* * * * *